United States Patent [19]

Alexander

[11] 3,931,693

[45] Jan. 13, 1976

[54] DUMP MECHANISM FOR TOY TRUCK

[75] Inventor: James C. Alexander, Orchard Park, N.Y.

[73] Assignee: The Quaker Oats Company, Chicago, Ill.

[22] Filed: Mar. 17, 1975

[21] Appl. No.: 558,678

[52] U.S. Cl. ..... 46/214; 46/40
[51] Int. Cl.[2] ..... A63H 17/06
[58] Field of Search ..... 46/214, 40

[56] References Cited

UNITED STATES PATENTS

| | | | |
|---|---|---|---|
| 2,581,201 | 1/1952 | Pettit | 46/214 |
| 2,702,963 | 3/1955 | Swenson | 46/214 X |
| 2,705,388 | 4/1955 | Gokey | 46/214 |
| 3,126,668 | 3/1964 | Bonanno et al. | 46/214 X |
| 3,260,013 | 7/1966 | Ryan | 46/214 X |

FOREIGN PATENTS OR APPLICATIONS

| | | | |
|---|---|---|---|
| 940,217 | 2/1956 | Germany | 46/214 |
| 1,052,960 | 12/1966 | United Kingdom | 46/214 |

*Primary Examiner*—Louis G. Mancene
*Assistant Examiner*—J. Q. Lever
*Attorney, Agent, or Firm*—Cumpston & Shaw

[57] ABSTRACT

An improved dump mechanism for a toy truck includes a dump lever having an upper surface curving downward toward the lifting end of the dump lever to engage an undersurface of the dump body. The curved surface of the dump lever is shaped for pivoting the dump body in increments that increase successively relative to corresponding successively equal pivotal increments of the dump lever throughout at least the initial half of the motion of the dump body from a load position to a full-dump position. This makes the pivoting of the dump body with the dump lever relatively easy with approximately even torque on the dump lever throughout the dumping motion.

10 Claims, 4 Drawing Figures

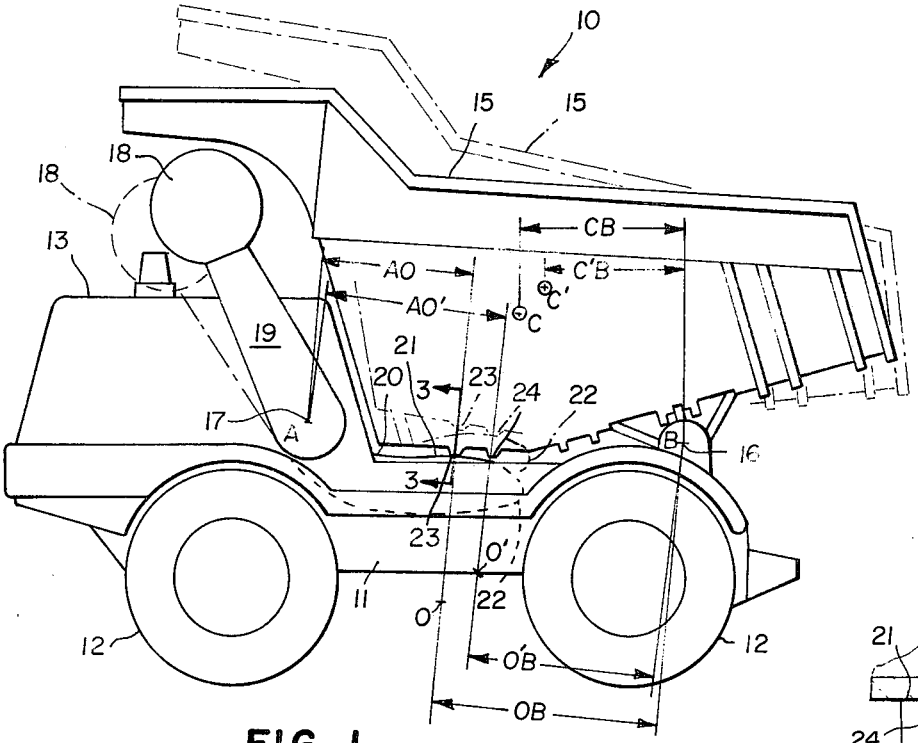
FIG. 1
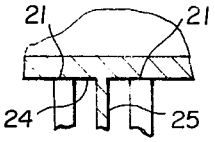
FIG. 3
FIG. 4
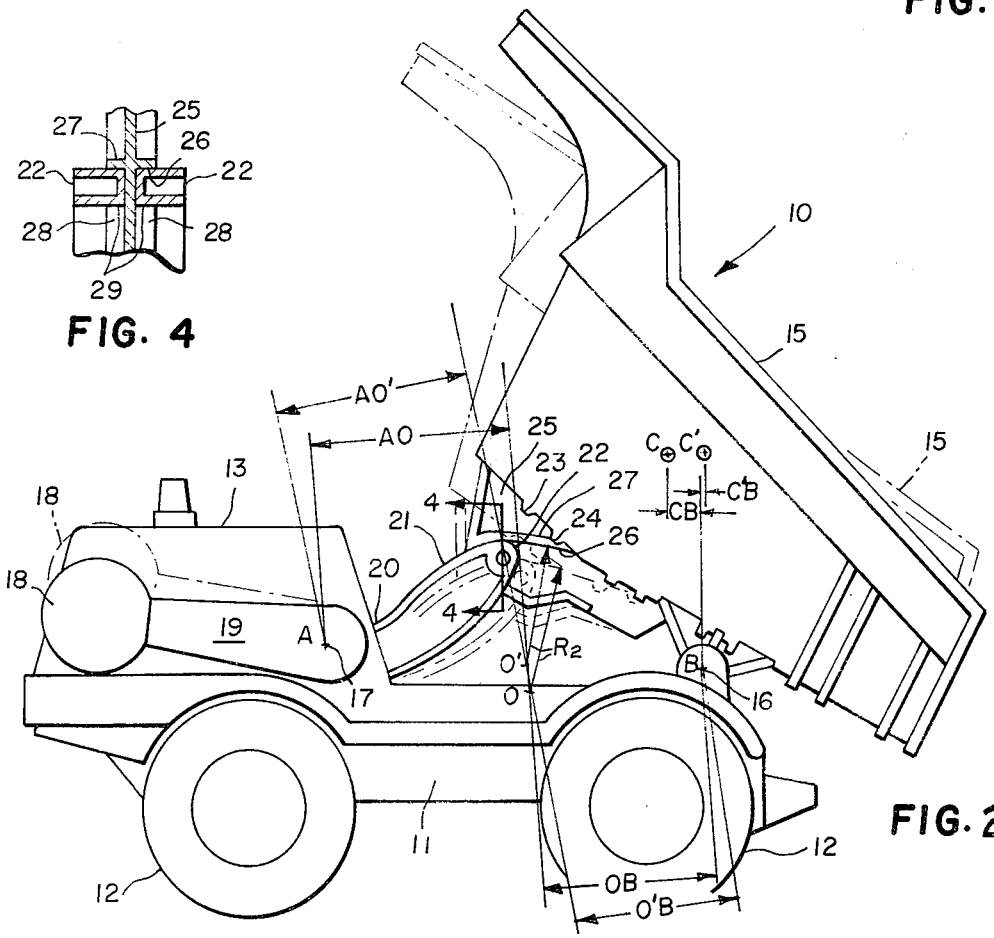
FIG. 2

DUMP MECHANISM FOR TOY TRUCK

THE INVENTIVE IMPROVEMENT

Toy dump trucks have been popular for years and are generally made to simulate real dump trucks with a pivotal dump lever in the region of a simulated cab for pivoting the dump body from a load position to a full-dump position. For many years this has been accomplished with a pivotal dump lever formed as a bent wire engaging the underside of the dump body but requiring very high initial torque to start the pivotal motion of the dump body and relatively light torque near the end of the dump motion. This has made the dump lever difficult for a small child to operate.

The invention involves recognition of the operating problems of prior art dump mechanisms for toy dump trucks, and the invention aims at an easy-to-operate dump lever that requires relatively low and relatively steady torque throughout the dump motion. The invention also aims at simplicity, economy, reliability, and a dump mechanism that is trouble-free, convenient and easy to operate, and satisfying in its action.

SUMMARY OF THE INVENTION

The inventive dump mechanism is applied to a toy dump truck having a chassis, a dump body mounted on a rear region of the chassis to pivot between a load position and a full-dump position, a simulated cab in a forward region of the chassis, and a dump lever pivotally mounted on the chassis near the simulated cab. The dump lever has an upper surface curving downward toward the lifting end of the dump lever, and the dump body has an undersurface engaged by the curved surface of the dump lever. The curved surface of the dump lever is shaped for pivoting the dump body in pivotal increments that increase successively relatiave to corresponding successively equal pivotal increments of the dump lever throughout at least the initial half of the motion of the dump body from the load position to the full-dump position. Preferably, the dump body also has a downwardly curving surface engaged by the lifting end of the dump lever after the dump lever pivots past the engagement with the undersurface of the dump body for pivoting the dump body the last few degrees to the full-dump position.

DRAWINGS

FIG. 1 is a side elevational view of a toy dump truck showing initial pivotal motion of the dump body by the inventive dump mechanism from the solid-line load position to a broken-line pivoted position;

FIG. 2 is a side elevational view of the inventive dump mechanism pivoting the dump body from a broken-line position to a solid-line full dump position;

FIG. 3 is a fragmentary, cross-sectional view of the dump mechanism of FIG. 1 taken along the line 3—3 thereof; and FIG. 4 is a fragmentary, cross-sectional view of the dump mechanism of FIG. 2 taken along the line 4—4 thereof.

DETAILED DESCRIPTION

The inventive dump mechanism is applied to a simulated dump truck 10 having a chassis 11 supported by wheels 12 and having a simulated cab 13 in its front end region. A dump body 15 is mounted for pivoting on an axis 16 in a rear region of chassis 11, and a dump lever

20 having an operating handle 19 and an operating knob 18 is mounted for pivoting on an axis 17 in the region of simulated cab 13. Dump lever 20 has an upper surface 21 curving downward toward the lifting end 22 of dump lever 20, and the undersurface of dump body 15 has a pair of transverse downwardly projecting ridges 23 and 24 engaging curved surface 21 during operation of dump lever 20. Instead of ridges 23 and 24, the undersurface of dump body 15 can be smooth and either straight or curved to engage curved surface 21 of dump lever 20.

A plate 25 extends downward from the undersurface of dump body 15, and curved surface 21 of dump lever 20 is preferably separated into two congruent portions straddling plate 25 as best shown in FIG. 3. Plate 25 has a downwardly curving surface 26 engaged by lifting end 22 of dump lever 20 in the final stages of a dump, and surface 26 is formed as edges 27 extending laterally outward from opposite sides of plate 25 as best shown in FIG. 4. The lifting end 22 of dump lever 20 has projections 29 extending inward from curved surfaces 21 to engage curved surface 26 on the underside of edge 27 extending outward from plate 25, and edges 28 extending outward at the lower forward region of plate 25 form stops or abutments engaged by projections 29 to limit the motion of dump body 15 to the full-dump position shown in solid lines in FIG. 2. Another pair of edges 30 extending laterally outward from the lower edge of plate 25 are engaged by projections 29 when dump lever 20 is pivoted back from the full-dump position shown in FIG. 2 to pivot dump body 15 from the full-dump position back toward the load position shown in FIG. 1.

In operation, dumping of toy truck 10 proceeds from the load position shown in solid lines in FIG. 1 with curved surface 21 of lever 20 engaging ridge 23 on the undersurface of dump body 15, and as lever 20 is pivoted counterclockwise as illustrated in FIG. 1, it begins to pivot dump body 15 and moves into engagement with ridge 24 as shown in broken lines in FIG. 1. As pivoting of dump lever 20 continues, its lifting end 22 eventually moves away from engagement with the undersurface of body 15 and engages curved surface 26 curving downward from the underside of body 15 as shown in FIG. 2 to pivot body 15 to the full-dump position. The curvatures of surface 21 on dump lever 20 and surface 26 on the underside of dump body 15 are formed to provide a relatively even and uniform lifting torque for dump body 15 as described below.

The inventive dump mechanism provides a variable ratio lift mechanism applying controlled torque to dump body 15. The force F exerted upward by lever 21 is applied along a line through the center of curvature O of surface 21 or surface 26 and through the point of engagement with dump body 15, and equals the force applied downward against lever 20 by dump body 15. The torque required to operate dump lever 20 is a function of the weight in the body and effective lever arms of dump lever 20 and dump body 15 at any given position. The effective lever arm of the dump body is a function of the horizontal distance CB from the center of gravity of dump body 15 to pivot B at the pivotal axis 16 of dump body 15 and the distance OB from dump body pivot B to the line of lifting force of dump lever 20. The lever arm AO of dump lever 20 is the distance from pivot A at pivot axis 17 to the line of lifting force. As dump body 15 pivots from the solid-line to the broken-line position of FIG. 1, the lifting lever arm AO of dump lever 20 increases to AO′, the distance OB decreases to O′B, and the horizontal distance CB also decreases to C′B because of pivotal motion of the center of gravity from C to C′. These parameters are related to the point of engagement between curved surface 21 and the undersurface of dump body 15 so that dump body 15 moves in pivotal increments that increase successively relative to corresponding successively equal pivotal increments of dump lever 20 throughout at least the initial half of the motion of dump body 15 from the load position shown in solid lines in FIG. 1 to the full-dump position shown in solid lines in FIG. 2.

An example of a preferred relation between the dump lever and the dump body is shown in the following table.

| Angle of Movement of | | Pivot of Dump Body For Each 5° of Dump Lever Pivot |
|---|---|---|
| Dump Lever | Dump Body | |
| 0 | 0 | |
| 5 | 2½ | 2½ |
| 10 | 6 | 3½ |
| 15 | 10 | 4 |
| 20 | 14½ | 4½ |
| 25 | 19 | 4½ |
| 30 | 24½ | 5½ |
| 35 | 30½ | 6 |
| 40 | 38 | 7½ |
| 45 | 46½ | 8½ |
| 50 | 53½ | 7 |
| 55 | 57 | 3½ |

The above table shows that during the initial pivotal motion of dump lever 20, dump body 15 pivots by relatively small increments that increase steadily during at least the first half of the dump body motion and preferably during about the first two-thirds of the dump body motion. The pivot rate of dump body 15 tapers off somewhat near the end of the approach toward the full-dump position, but such a tapering off is not necessary, because dump body motion requires relatively little torque as body 15 approaches the full-dump position where the center of gravity of dump body 15 is nearly above pivot axis 16. By adjusting the curvatures of surface 21 of dump lever 20 and surface 26 on dump body 15, the lever arm of dump lever 20 and the effective operating lever arm of dump body 15 are preferably made to produce approximately the results shown in the above table so that dump lever 20 has a mechanical advantage applying relatively greater force to dump body 15 during the initial stages of the dump and has a mechanical advantage applying relatively greater motion to dump body 15 during the later stages of the dump. The effect from the point of view of the child operating truck 10 is that relatively steady and low torque applied to handle 18 of dump lever 20 raises dump body 15 evenly but at varying rates from the load position to the full-dump position without requiring any excessive torque during the initial stages of the dump.

Dump body 15 stops in the full-dump position when projections 29 at the lifting end 22 of dump lever 20 engage stop edges 28 on plate 25, and when dump lever 20 is moved away from the full-dump position, projections 29 engage edges 30 along the lower edge of plate 25 to pivot dump body 15 back toward the load position of FIG. 1. The center of gravity of dump body 15 in the full-dump position shown in solid lines in FIG. 2 is preferably slightly behind pivot axis 16 as illustrated so that dump body 15 remains upward when truck 10 is level. A slight pivot downward by return of dump lever 20 from the full-dump position moves the center of gravity of dump body 15 back ahead of pivot axis 16, so that dump body 15 pivots from that point back down to the load position of FIG. 1 under its own weight.

Dump lever 20 can be made longer and more curved to eliminate the need for curved surface 26 extending downward from dump body 15, but the illustrated arrangement including curved surface 26 is preferred for compactness, simplicity, and improved appearance. The undersurface of dump body 15 can also have various shapes besides transverse ridges 23 and 24 and can be curved to cooperate with the curvature of surface 21 of dump lever 20. Truck 10 can also have many different styles, and those skilled in the art will appreciate other ways of configuring the inventive dump mechanism to achieve the desired variable-ratio effect.

I claim:

1. In a toy truck having a chassis, a dump body mounted on a rear region of said chassis to pivot between a load position and a full-dump position, a simulated cab in a forward region of said chassis, and a dump lever pivotally mounted on said chassis near said simulated cab, an improved dump mechanism comprising:

a. said dump lever having an upper surface curving downward toward a lifting end of said dump lever;

b. said dump body having an undersurface engaged by said curved surface of said dump lever; and c. said curved surface of said dump lever and said body undersurface being shaped for pivoting said dump body in pivotal increments that increase successively relative to corresponding successively equal pivotal increments of said dump lever throughout at least the initial half of the motion of said dump body from said load position to said full-dump position.

2. The dump mechanism of claim 1 wherein said dump body has a downwardly curving surface engaged by said lifting end of said dump lever after said dump lever pivots past said engagement with said undersurface of said dump body for pivoting said dump body the last few degrees to said full-dump position.

3. The dump mechanism of claim 1 wherein said curved surface of said dump lever is separated into two portions straddling said downwardly curving surface of said dump body.

4. The dump mechanism of claim 3 wherein said lifting end of said dump lever has projections extending inward from said curved surfaces under said downwardly curving surface of said dump body.

5. The dump mechanism of claim 4 wherein said dump body has a surface engaging said projections at said full-dump position to prevent motion of said dump body beyond said full-dump position.

6. The dump mechanism of claim 5 wherein said dump body has a surface engaged by said projections when said dump lever is moved back from said full-dump position to pivot said dump body back from said full-dump position toward said load position.

7. The dump mechanism of claim 6 wherein said dump body has a plate extending downward between said curved surfaces of said dump lever and said downwardly curving surface of said dump body, said surface engaging said projections at said full-dump position, and said surface engaged by said projections when said dump lever is moved back from said full-dump position are all formed as edges projecting laterally outward from opposite sides of said plate.

8. The dump mechanism of claim 1 wherein said undersurface of said dump body engaging said curved surface of said dump lever is formed as transverse, downwardly projecting ridges.

9. The dump mechanism of claim 8 wherein said dump body has a downwardly curving surface engaged by said lifting end of said dump lever after said dump lever pivots past said engagement with said undersurface of said dump body for pivoting said dump body the last few degrees to said full-dump position.

10. The dump mechanism of claim 9 wherein said curved surfaces of said dump lever is separated into two portions straddling said downwardly curving surface of said dump body.

* * * * *